US005419643A

United States Patent [19]

Matsuura

[11] Patent Number: 5,419,643

[45] Date of Patent: May 30, 1995

[54] ATTACHMENT FOR INK RIBBON REPLACEMENT AND INK RIBBON CASSETTE APPLICABLE THERETO

[75] Inventor: Takanobu Matsuura, Morioka, Japan

[73] Assignee: Alps Electric Co., Ltd., Tokyo, Japan

[21] Appl. No.: 221,723

[22] Filed: Apr. 1, 1994

[30] Foreign Application Priority Data

Apr. 7, 1993 [JP] Japan ..... 5-080747

[51] Int. Cl.[6] ..... B41J 35/28

[52] U.S. Cl. ..... 400/208; 400/613; 400/692; 400/242; 242/347.2

[58] Field of Search ..... 400/207, 208, 208.1, 400/242, 247, 250, 613, 619.1, 717, 692; 29/426.6; 242/347.2, 347.4

[56] References Cited

U.S. PATENT DOCUMENTS

| | | | |
|---|---|---|---|
| 3,294,228 | 12/1966 | Urso et al. | 400/208 |
| 3,432,111 | 3/1969 | Ryder | 242/347.2 X |
| 4,160,605 | 7/1979 | Neubaum | 400/208 |
| 4,325,646 | 4/1982 | Sasaki | 400/208 X |
| 4,367,963 | 1/1983 | Daughters | 400/208 |
| 4,413,919 | 11/1983 | Applegate et al. | 400/208 |
| 4,605,325 | 8/1986 | Hofmann | 400/207 |
| 4,955,737 | 9/1990 | Haftmann et al. | 400/208 |

FOREIGN PATENT DOCUMENTS

| | | | |
|---|---|---|---|
| 0489717 | 6/1992 | European Pat. Off. | 400/208 |
| 0221106 | 8/1993 | Japan | 400/208 |

*Primary Examiner*—Chris A. Bennett

*Attorney, Agent, or Firm*—Guy W. Shoup; Patrick T. Bever

[57] ABSTRACT

The present invention aims at performing in a simple manner the replacement of an ink ribbon contained in an ink ribbon cassette. To this end, the attachment 11 for ink ribbon replacement according to the present invention is provided with a table portion 12 for resting the ink ribbon cassette thereon. On the upper surface of the table portion 12 is provided a positioning member 13 for positioning the ink ribbon cassette and are also provided projections 16 for pushing retaining members 10 which hold upper and lower cassette cases 6*b*, 6*a* integrally with each other, to release the engagement of both cassette cases. When the ink ribbon cassette is put on the attachment 11 for ink ribbon replacement, the retaining members 10 of the ink ribbon cassette are pushed by the projections 16 of the attachment to thereby disengage the upper and lower cassette cases 6*b*, 6*a* of the ink ribbon cassette from each other.

6 Claims, 2 Drawing Sheets

ATTACHMENT FOR INK RIBBON REPLACEMENT AND INK RIBBON CASSETTE APPLICABLE THERETO

BACKGROUND OF THE INVENTION

1. Field of the Invention

The present invention relates to an attachment for the replacement of an ink ribbon contained in an ink ribbon cassette, as well as an ink ribbon cassette suitable for the replacement of an ink ribbon using said attachment.

2. Description of the Related Art

The ink ribbon cassette referred to above has an ink ribbon accommodated in the interior thereof and it is put onto a printer such as a thermal printer or a dot printer to effect printing.

The thermal printer is generally constructed as follows.

In the thermal printer with its top cover opened, a flat plate like-platen is disposed nearly centrally of a frame in the interior thereof in such a manner that a printing surface thereof faces substantially in the vertical direction. In front of the platen and in a lower position there is disposed a carriage in parallel with the platen. Further, at the front edge of the above frame there is formed a flange-like guide portion, and the carriage is in engagement with the carriage shaft and the guide portion so that it can reciprocate along the carriage shaft and the guide portion.

A thermal head is attached to the front end portion of the carriage so as to be opposed to the platen. On the carriage are disposed a take-up reel driving shaft adapted to fit in a take-up reel of an ink ribbon cassette to rotate the reel, and a feed reel guide shaft for guiding a feed reel of the ink ribbon cassette rotatably. The ink ribbon cassette, in which an ink ribbon is contained and is guided to the position between the thermal head and the platen, is loaded onto the carriage removably.

When the ink ribbon contained in the conventional ink ribbon cassette for the thermal printer has been consumed completely, the cassette case can be re-used by the replacement of only the ink ribbon.

In the conventional ink ribbon cassette, however, the whole of the cassette case with ink ribbon is in many cases discarded without making ribbon replacement because the cassette case opening operation by releasing the engagement of a retaining member which is for holding upper and lower cassette cases as constituents of an ink ribbon cassette body integrally with each other, and the handling of a ribbon feed roller supported within the ink ribbon cassette, are troublesome.

However, in the recent clamor for resources saving, it has become necessary to simplify the replacement work for ink ribbon alone with a view to making the most of an employable member.

SUMMARY OF THE INVENTION

It is an object of the present invention to overcome the above-mentioned problems encountered in the conventional ink ribbon cassette and provide an attachment which permits easy replacement of an ink ribbon in an ink ribbon cassette used for a thermal printer, as well as such an ink ribbon cassette.

It is another object of the present invention to provide an attachment for ink ribbon replacement having a table portion for resting an ink ribbon cassette thereon, the cassette having upper and lower cassette cases and having an ink ribbon in the interior thereof, an ink ribbon cassette positioning member provided on the upper surface of the table portion, and a projection also provided on the upper surface of the table portion for pushing a retaining member which holds the upper and lower cassette cases integrally with each other, to release the engagement of both cassette cases.

It is a further object of the present invention to provide an ink ribbon cassette having upper and lower cassette cases which are made integral with each other by means of a retaining member and also having an ink ribbon in the interior thereof, the lower cassette case having an opening for exposing the retaining member therethrough to the exterior of both cassette cases.

According to the attachment for ink ribbon replacement and ink ribbon cassette applicable thereto both of the present invention constructed as above, upon placing the ink ribbon cassette on the attachment for ink ribbon replacement, the retaining member of the cassette is pushed by the projection of the attachment, whereby the upper and lower cassette cases can be disengaged from each other, so that the ink ribbon cassette can be opened easily and ink ribbon replacement can be done in a simple manner.

Further, by providing a guide member for guiding a ribbon feed roller mounted upright in the interior of the ink ribbon cassette, the ink ribbon replacement can be performed without falling-down of the ribbon feed roller even upon removal of the upper cassette case of the ink ribbon cassette.

DETAILED DESCRIPTION OF THE PREFERRED EMBODIMENT

Figure 1:
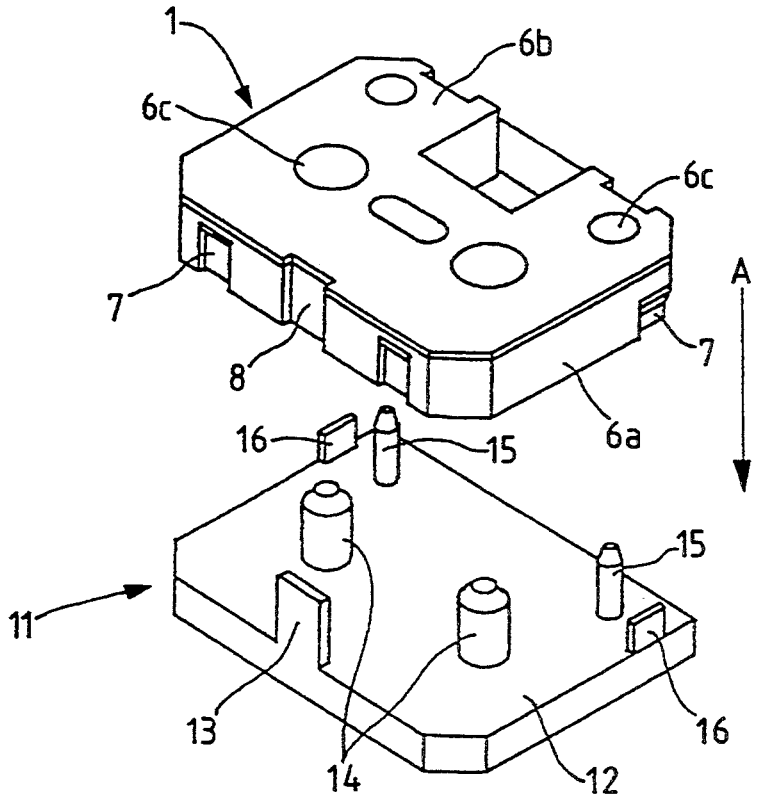
FIG. 1 is a perspective view of an attachment for ink ribbon replacement and an ink ribbon cassette applicable thereto according to an embodiment of the present invention.

The present invention will be described below by way of an embodiment thereof illustrated in the drawings.

FIGS. 1 to 4 are explanatory views showing an attachment for ink ribbon replacement and an ink ribbon cassette applicable thereto according to an embodiment of the present invention.

The ink ribbon cassette according to this embodiment comprises a cassette body 1 composed of a lower cassette case *6a* and an upper cassette case *6b* both of which will be described later. In the interior defined by both cassette cases *6a* and *6b* there are disposed a feed reel 2 and a take-up reel 3 each supported rotatably, and an ink ribbon 4 is wound round both reels 2 and 3 in such a manner that the winding starts with both ends of the ink ribbon. Inside both cassette cases *6a* and *6b* there are disposed guide rollers 5 for guiding the ink ribbon 4 during travel of the ink ribbon from the feed reel 2 to the take-up reel 3. Both reels 2, 3 and the guide rollers 5 are rotatably supported in a sandwiched fashion between both cassette cases 6*a* and 6*b* and in a fitted state in support apertures 6*c* formed in an opposed manner in both cassette cases.

The lower cassette case 6*a* of the ink ribbon cassette which contains the ink ribbon 4, etc. as described above is formed in the shape of a receiving box by a flat plate-like bottom wall 6*d* and side walls 6*e* erected along the outer peripheral edge of the bottom wall 6*d*. A generally ⊐-shaped recess 8 is formed in a central part of the outer surface of the side wall 6*e* positioned on the side opposite to the platen-side side wall 6*e*. In the same side wall 6*e* located on the side opposite to the platen-side side wall 6*e* there are formed two apertures 7 from the bottom wall 6*d* side of the lower cassette case and at an appropriate spacing from each other on both sides of the recess 8. Also in each of the two side walls extending in the direction (hereinafter referred to as the "transverse direction") orthogonal to the platen-side side wall 6*e* there is formed one aperture 7, which apertures in said two side walls are formed in positions near the guide rollers 5, 5.

Figures 2A, 2B:
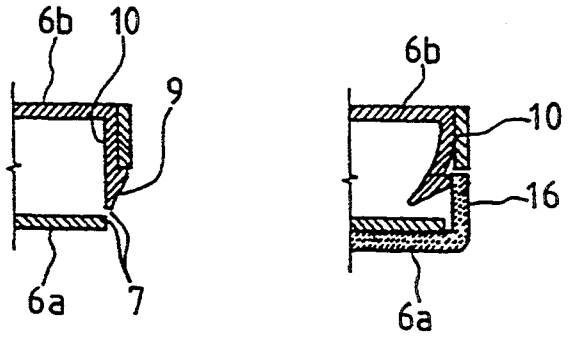
FIG. 2A is a vertical sectional view showing a principal portion of cassette cases of the ink ribbon cassette and FIG. 2B is a vertical sectional view showing the state of said principal portion, with the ink ribbon cassette placed on the attachment.

The upper cassette case 6*b* is formed in the shape of a flat plate of a lid type to be put on the lower cassette case 6*a*, and on the back thereof are formed flexible retaining members 10 in positions corresponding to the positions of the apertures 7, the retaining members 10 each having at a front end portion thereof a slant face 9 which faces to the outside of the cassette body 1 and which is smaller in wall thickness at the lower, front end side. As shown in FIG. 2A, the cassette body 1 of the ink ribbon cassette is fabricated by bringing the retaining members 10 of the upper cassette case 6*b* into engagement with end portions of the apertures 7 of the lower cassette case 6*a* in such a manner that the slant face 9 of each retaining member 10 is exposed from the associated aperture 7.

The attachment for ink ribbon replacement, indicated at 11, according to this embodiment has a flat plate-like table 12 of about the same size and shape as the ink ribbon cassette used, as shown in FIG. 1. A flat plate-like positioning member 13 adapted to fit in the recess 8 to determine the position of the ink ribbon cassette is formed integrally with the table 12 and nearly centrally of an end portion of the upper surface of the table 12 on which end side is positioned the side wall 6*e* opposite to the platen-side side wall 6*e* of the ink ribbon cassette on the same table.

Spool supporting shafts 14, 14 adapted to fit in the spools of the feed reel 2 and take-up reel 3 of the ink ribbon cassette are erected on the table 12 approximately centrally in the transverse direction of the table and at a spacing equal to the spacing between both reels 2 and 3.

Guide pins 15 adapted to fit in the guide rollers 5, 5 of the ink ribbon cassette are also erected on the table 12 in both end positions on the side opposed to the platen and inside the cassette body 1 on the table.

Further, pawl members 16 as projections are formed at both transversely extending end portions of the table 12 in positions corresponding to apertures 7 in a loaded state of the ink ribbon cassette onto the table. As shown in FIG. 2B, the pawl members 16 are each in the form of a flat plate which comes into abutment with the slant face 9 of the associated retaining member 10 fitted in the aperture 7 to push the retaining member upward from the table 12 side, thereby releasing the locked state of the cassette body 1.

The operation of this embodiment constructed as above will now be described.

First, the spool supporting shafts 14, 14 provided on the upper surface of the attachment 11 for ink ribbon replacement are fitted in the spools of the feed reel 2 and take-up reel 3 of the ink ribbon cassette body 1 while allowing the recess 8 of the ink ribbon cassette to slide along the positioning member 13 of the attachment 11, and likewise the guide pins 15, 15 are fitted in the guide rollers 5, 5, allowing the ink ribbon cassette to be placed on the attachment.

In this case, when the ink ribbon cassette moves in the direction of arrow A in FIG. 1 and is thereby put on the attachment 11 for ink ribbon replacement, the pawl members 16 provided projectingly on the upper surface of the attachment 11 in positions corresponding to the positions of apertures 7 on the ink ribbon cassette side come into abutment with the slant faces 9 of the retaining members 10 of the upper cassette case 6*b* engaged with end portions of the apertures 7 of the lower cassette case 6*a*, as shown in FIG. 2B, and as the ink ribbon cassette is further pushed toward the attachment 11 (downward), the pawl members 16 cause the retaining members 10 to bend and retract forcibly into the cassette body 1.

Figure 3:
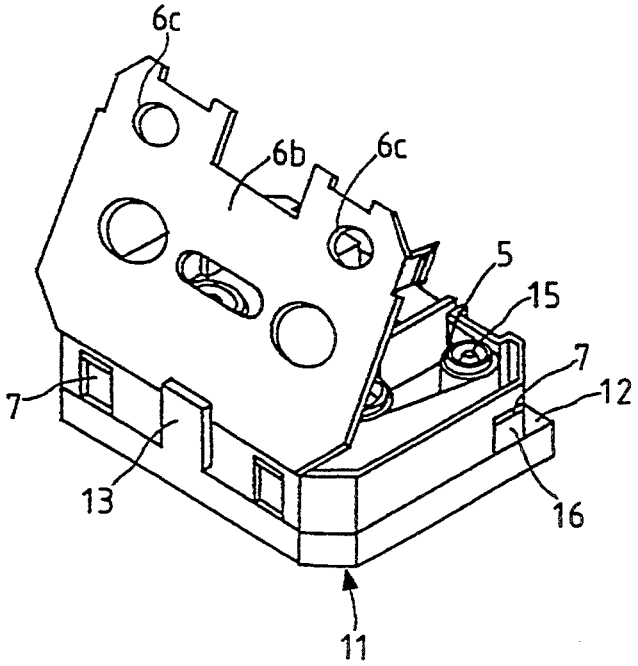
FIG. 3 is a perspective view showing a process of removing an upper cassette case, using the attachment for ink ribbon replacement.

As a result, the engagement of the upper and lower cassette cases 6*b*, 6*a* of the ink ribbon cassette is released on the ink ribbon feed side. Moreover, as shown in FIG. 3, the engagement of the apertures 7 and retaining members 10 disposed on the side opposite to the ink ribbon feed side can also be released by opening the upper cassette 6*b* pivotally using the side face opposite to the platen-side side face as a pivot shaft.

Figure 4:
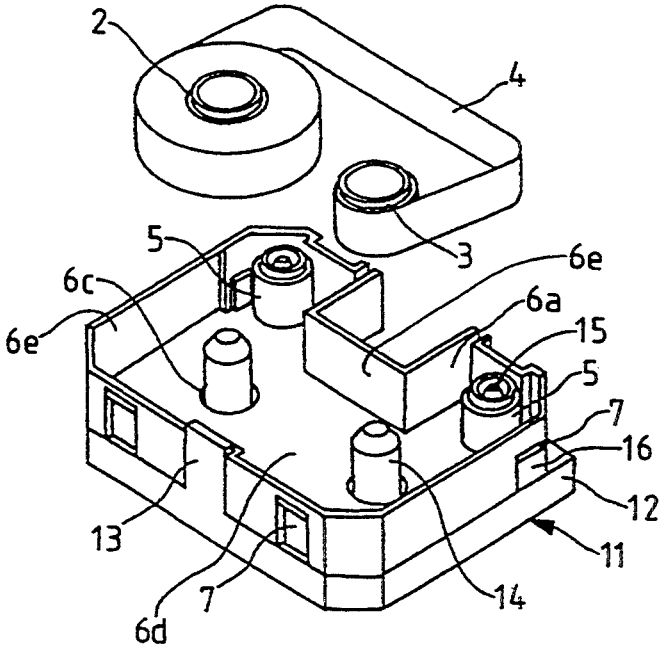
FIG. 4 is a perspective view showing an ink ribbon removed state using the attachment for ink ribbon replacement.

Then, the upper cassette case 6*b* is removed and, as shown in FIG. 4, the feed reel 2 and the take-up reel 3 with both ends of a single ink ribbon 4 wound on the two are replaced with feed and take-up reels 2, 3 with a new ink ribbon 4 wound thereon.

During this ink ribbon replacing work, there is no fear of falling-down of the guide rollers 5, 5 because the guide rollers are fitted on the guide pins 15, 15 erected on the attachment 11 for ink ribbon replacement, and also as to the feed and take-up reels 2, 3 with a new ink ribbon 4 wound thereon, they can be fitted on and along the spool supporting shafts 14, 14 projecting inside the lower cassette case 6*a* and thus can be loaded into the same cassette case.

After the replacement of the ink ribbon 4, by engaging the upper cassette case 6*b* with the lower cassette case 6*a* in the procedure reverse to the upper cassette case 6*b* removing procedure described above and by subsequent removal of the ink ribbon cassette from the attachment 11 for ink ribbon replacement, the ink ribbon replacing work is completed.

Thus, according to the attachment 11 for ink ribbon replacement and the ink ribbon cassette of this embodiment, when the ink ribbon cassette is put on the attachment 11, the retaining members 10 of the ink ribbon cassette are pushed by the pawl members 16 of the attachment, whereby the upper and lower cassette cases 6*b*, 6*a* of the ink ribbon cassette can be disengaged from each other easily. Further, since the guide pins 15 for guiding the ribbon feeding guide rollers 5 erected inside the ink ribbon cassette are provided on the attachment 11, there is no fear of falling-down of the ink ribbon guiding rollers 5 even upon removal of the upper cassette case 6*b* of the ink ribbon cassette. Thus, the drawback in the conventional ink ribbon replacement is eliminated and the ink ribbon 4 replacing work can be done in a simple and positive manner.

The present invention is not limited to the above embodiment, but modifications may be made as necessary. For example, the attachment for ink ribbon replacement may be formed integrally with the case of the printer body, not separately from the printer.

According to the present invention, as set forth above, the user can change ink ribbons in a simple manner and hence will no longer discard the ink ribbon cassette after consumption of the ink ribbon contained therein, thus leading to resources saving.

What is claimed is:

1. An apparatus comprising:

an ink ribbon cassette having upper and lower lower cassette cases connected by a retaining member, the ink ribbon cassette defining an interior for removably storing an ink ribbon;

a table portion having an upper surface for receiving said ink ribbon cassette thereon;

an ink ribbon cassette positioning member provided on the upper surface of said table portion; and a projection also provided on the upper surface of said table portion for pushing the retaining member which holds said upper and lower cassette cases integrally with each other, thereby releasing the engagement of said cassette cases.

2. An apparatus comprising:

an ink ribbon cassette having upper and lower lower cassette cases connected by a retaining member, the ink ribbon cassette defining an interior for removably storing an ink ribbon;

a table portion having an upper surface for receiving said ink ribbon cassette thereon;

an ink ribbon cassette positioning member provided on the upper surface of said table portion; and a protection also provided on the upper surface of said table portion for pushing the retaining member which holds said upper and lower cassette cases integrally with each other, thereby releasing the engagement of said cassette cases;

wherein said apparatus further includes a guide member provided on the upper surface of said table portion for guiding an ink ribbon feed roller disposed within said ink ribbon cassette.

3. A printing device comprising:

an ink ribbon cassette having upper and lower lower cassette cases connected by a retaining member, the ink ribbon cassette defining an interior for removably storing an ink ribbon;

a table portion having an upper surface for receiving said ink ribbon cassette thereon;

an ink ribbon cassette positioning member provided on the upper surface of said table portion; and a projection also provided on the upper surface of said table portion for pushing the retaining member which holds said upper and lower cassette cases integrally with each other, thereby releasing the engagement of said cassette cases.

4. The printing device according to claim 3, further comprising a guide member provided on the upper surface of said table portion for guiding an ink ribbon feed roller disposed within said ink ribbon cassette.

5. (New) The printing device according to claim 3, wherein the printing device is a thermal transfer printer.

6. (New) The printing device according to claim 3, wherein the printing device is a dot matrix printer.

* * * * *